US011607795B2

(12) United States Patent
Brauer et al.

(10) Patent No.: US 11,607,795 B2
(45) Date of Patent: Mar. 21, 2023

(54) ROTATING HANDLE AND RELATED METHODS

(71) Applicants: Kenneth J. Brauer, Elkhorn, WI (US); Scott J. Emmerich, Delavan, WI (US)

(72) Inventors: Kenneth J. Brauer, Elkhorn, WI (US); Scott J. Emmerich, Delavan, WI (US)

( * ) Notice: Subject to any disclaimer, the term of this patent is extended or adjusted under 35 U.S.C. 154(b) by 0 days.

(21) Appl. No.: 16/900,638

(22) Filed: Jun. 12, 2020

(65) Prior Publication Data

US 2021/0180912 A1 Jun. 17, 2021

Related U.S. Application Data

(63) Continuation-in-part of application No. 29/717,089, filed on Dec. 13, 2019.

(51) Int. Cl.

| | |
|---|---|
| ***B25G 1/06*** | (2006.01) |
| ***B25G 3/08*** | (2006.01) |
| ***B25G 3/24*** | (2006.01) |
| ***F41C 23/16*** | (2006.01) |
| ***B25F 5/02*** | (2006.01) |

(Continued)

(52) U.S. Cl.

CPC ..... *B25G 1/06* (2013.01); *B25D 17/04* (2013.01); *B25D 17/046* (2013.01); *B25F 5/026* (2013.01); *B25G 1/066* (2013.01); *B25G 3/08* (2013.01); *B25G 3/24* (2013.01); *B25G 3/28* (2013.01);

(Continued)

(58) Field of Classification Search

CPC .... F41C 23/16; Y10T 16/469; Y10T 16/4713; A01B 1/026; B25D 17/04; B25D 17/043; B25D 17/046; B25F 5/024; B25F 5/026; B25G 1/01; B25G 1/06; B25G 1/066; B25G 3/08; B25G 3/24; B25G 3/28; F16B 2/18; F16B 2/185; F16B 21/02

See application file for complete search history.

(56) References Cited

U.S. PATENT DOCUMENTS 237,891 A * 2/1881 Musselman ..... B25G 1/00 294/58
445,192 A * 1/1891 Nye et al. ..... F41C 23/16 43/25

(Continued)

OTHER PUBLICATIONS

Fab Defense, Fab Defense Rotating Tactical Foregrip & Bipod, https://web.archive.org/web/20120222195844/http://www.fab-defense.com/en/categor y-bipods.html, retrieved on Jun. 15, 2020.

*Primary Examiner* — Jeffrey O'Brien

(74) *Attorney, Agent, or Firm* — Fitch, Even, Tabin, Flannery LLP

(57) ABSTRACT

Rotatable handles and related methods are disclosed herein. In one form, the handle has a clip member that fits around a cylindrical object and a handle. The clip member includes a track that guides rotation of the handle about a longitudinal axis of the cylindrical object. The handle includes an actuator that operates a braking member which comprises a braking surface that is movable into and out of contact with the track. When the braking surface is out of contact the track, the handle is movable relative to the track when permitting the handle to rotate about a longitudinal axis of the cylindrical object. Rotating the handle about the longitudinal axis of the handle operates the actuator, causing the braking surface to move into and out of contact with the track. Various methods are also disclosed herein with respect to the rotatable handle.

14 Claims, 10 Drawing Sheets

(51) Int. Cl.
*B25D 17/04* (2006.01)
*B25G 3/28* (2006.01)

(52) U.S. Cl.
CPC ..... *F41C 23/16* (2013.01); *Y10T 16/469* (2015.01); *Y10T 16/4713* (2015.01)

(56) References Cited

U.S. PATENT DOCUMENTS 1,257,799 A * 2/1918 Brown ..... G05G 1/12 81/114
1,945,430 A * 1/1934 Garrett ..... A01B 1/225 294/58
2,134,020 A * 10/1938 Anson ..... B62D 1/043 16/DIG. 30
2,410,882 A * 11/1946 Lansden ..... A01D 1/14 294/58
2,771,697 A * 11/1956 Reising ..... F41C 23/16 42/71.01
2,826,848 A * 3/1958 Davies ..... F41C 23/16 42/71.01
3,341,235 A * 9/1967 Mattson ..... F16B 2/08 403/234
3,728,809 A 4/1973 Mulich
4,033,010 A * 7/1977 McCalla ..... B25G 3/24 74/543
4,276,675 A * 7/1981 Pioch ..... B25F 5/026 74/544
4,368,556 A * 1/1983 Wanner ..... B25F 5/003 451/344
4,567,810 A 2/1986 Preston
4,881,294 A * 11/1989 Riedl ..... B25F 5/026 16/DIG. 40
5,230,154 A * 7/1993 Decker ..... B26B 25/002 30/329
5,352,060 A * 10/1994 Poetker ..... F16B 7/044 294/58
5,625,922 A * 5/1997 Morad ..... B25G 3/24 294/58
6,317,930 B1 * 11/2001 Hung ..... G05G 1/08 403/97
6,397,507 B1 * 6/2002 Marshall ..... F41C 23/16 42/106
6,484,361 B1 11/2002 Schmid
6,782,791 B2 8/2004 Moore
6,814,156 B2 * 11/2004 Dieterle ..... B25F 5/026 173/217
6,928,945 B1 * 8/2005 Tebo, Jr. ..... B63B 21/54 114/230.15
7,137,542 B2 * 11/2006 Oki ..... B25F 5/006 173/162.1
7,191,557 B2 * 3/2007 Gablowski ..... F41C 23/16 42/72
7,222,451 B2 5/2007 Keng
7,454,858 B2 * 11/2008 Griffin ..... F41G 1/35 42/72
7,513,856 B2 * 4/2009 Jones ..... F16B 2/10 482/107
7,578,089 B1 * 8/2009 Griffin ..... F41C 23/22 42/72
7,611,413 B2 * 11/2009 Ryan ..... A61F 5/37 463/47.2
7,665,239 B1 2/2010 Moody
7,676,975 B2 * 3/2010 Phillips ..... F41C 23/16 42/72
7,823,256 B2 * 11/2010 Engelfried ..... B25F 5/026 16/426
8,032,990 B2 * 10/2011 Shinma ..... B25F 5/026 16/426
8,069,603 B2 * 12/2011 Moody ..... F41A 23/10 42/72
8,132,296 B2 * 3/2012 Di Nicolantonio ..... B25F 5/026 16/426
8,166,614 B2 * 5/2012 Martin ..... B25F 5/026 16/422
8,176,669 B1 * 5/2012 Griffin ..... F41C 23/14 42/90
8,186,018 B2 * 5/2012 Martin ..... B25F 5/026 16/436
8,215,047 B2 * 7/2012 Ash, Jr. ..... F41C 23/14 42/71.01
8,256,528 B2 * 9/2012 Oesterle ..... B25F 5/006 173/162.1
8,342,705 B2 * 1/2013 Yaksich ..... B25F 5/021 362/109
8,393,104 B1 * 3/2013 Moody ..... F41C 27/00 42/71.01
8,397,419 B2 * 3/2013 Williams ..... F41G 11/003 42/90
8,407,860 B2 * 4/2013 Brennenstuhl ..... B25F 5/026 16/422
8,429,843 B2 * 4/2013 Yan ..... F41G 11/003 42/71.01
8,607,492 B2 12/2013 Hartley
8,621,719 B2 * 1/2014 Nakashima ..... B25F 5/006 16/422
8,914,947 B2 * 12/2014 Weiss ..... B25D 17/043 16/431
8,984,789 B2 * 3/2015 Adcock, Jr. ..... F41C 23/22 42/106
9,234,722 B2 * 1/2016 Rice ..... F41C 23/16
9,308,638 B2 * 4/2016 Kondo ..... B25F 5/02
9,314,913 B2 * 4/2016 Ikuta ..... B25D 17/04
9,463,566 B2 * 10/2016 Yoshikane ..... B25G 1/01
9,498,876 B2 * 11/2016 Schubert ..... B25G 1/10
9,507,371 B1 * 11/2016 Day ..... A45F 5/10
9,523,551 B2 * 12/2016 Iannello ..... F41G 11/003
9,709,356 B1 * 7/2017 Anstett ..... F41C 23/16
9,775,272 B1 * 10/2017 Gilbert ..... A01B 1/026
10,197,358 B2 * 2/2019 Hebden ..... F41C 23/16
10,252,349 B2 * 4/2019 Cuenca ..... F41C 23/16
10,260,841 B2 * 4/2019 Kincel ..... F41G 11/003
10,442,073 B2 * 10/2019 Brauer ..... B25F 5/026
10,837,193 B2 * 11/2020 Andrews ..... F16M 11/041
10,866,062 B1 * 12/2020 Derousse ..... F41C 27/00
10,942,004 B2 * 3/2021 Grenier ..... F41C 23/16
10,996,022 B1 * 5/2021 Golomb ..... F41C 23/16
2004/0163214 A1 * 8/2004 Cheng ..... B25F 5/026 16/426
2007/0209162 A1 * 9/2007 McRoberts ..... B25F 5/026 16/426
2007/0271832 A1 * 11/2007 Griffin ..... F41C 23/16 42/72
2008/0078067 A1 * 4/2008 Nicolantonio ..... B25F 5/026 16/110.1
2009/0193702 A1 * 8/2009 Lin ..... F41C 23/16 42/72
2009/0313873 A1 * 12/2009 Roth ..... F41C 23/16 42/72
2010/0115730 A1 * 5/2010 Holland ..... B25G 1/102 16/422
2011/0011609 A1 * 1/2011 Simm ..... B25F 5/026 173/171
2011/0173778 A1 * 7/2011 Wales ..... B25G 1/06 16/426
2013/0104441 A1 * 5/2013 Kincel ..... F41G 11/004 42/90
2014/0020210 A1 * 1/2014 Brennenstuhl ..... B25G 1/00 16/426
2014/0259533 A1 * 9/2014 Day ..... A45F 5/10 16/426
2016/0084606 A1 * 3/2016 Michal ..... F41C 27/00 42/90
2016/0129579 A1 * 5/2016 Friedrich ..... B25D 17/043 173/162.2
2016/0250740 A1 * 9/2016 Ikuta ..... B25F 5/026 173/198
2017/0106525 A1 * 4/2017 Brauer ..... B25G 1/06
2017/0252833 A1 * 9/2017 Bayona Salazar ..... B25F 5/026
2017/0312904 A1 * 11/2017 Wiedner ..... B25F 5/026

(56) References Cited

U.S. PATENT DOCUMENTS

| | | | | |
|---|---|---|---|---|
| 2018/0050447 | A1* | 2/2018 | Geiger | B25F 5/006 |
| 2018/0215016 | A1* | 8/2018 | Allen | B25B 27/10 |
| 2018/0229356 | A1* | 8/2018 | Steingruber | B25F 5/026 |
| 2020/0047324 | A1 | 2/2020 | Brauer | |

* cited by examiner

DETAIL A
UNLOCKED

ROTATING HANDLE AND RELATED METHODS

CROSS REFERENCE TO RELATED APPLICATIONS

This application is a continuation-in-part of U.S. application Ser. No. 29/717,089 filed Dec. 13, 2019, which is incorporated herein by reference in its entirety.

FIELD OF THE INVENTION

This invention relates generally to a handle assembly, and more specifically, to a rotatable handle assembly.

BACKGROUND OF THE INVENTION

There exist many applications in which the ability to quickly and easily reorient/reposition/rotate a handle about a cylindrical body exist. For example, operators of a tactical rifle may find that different circumstances call for different orientations of a fore grip of the tactical rifle. Unfortunately, many conventional systems only allow the operator to move a fore grip handle forward and rearward, unless the fore grip is removed from the rifle. If the operator wishes to change the orientation of the fore grip, the operator must remove the fore grip from a rail system (e.g., a Picatinny rail system or M-LOK rail stem) featured on the tactical rifle and reposition the fore grip. Not only is this time consuming and relatively difficult, but the operator is forced to choose an orientation from a small number of predetermined positions (e.g., four positions spaced approximately at 90° intervals) provided by the rail system.

Other conventional systems include a base for sliding forward and rearward on the Picatinny rail in a horizontal direction and having a handle that is rotatable about a generally vertical rotation axis, such as one extending through the longitudinal axis of the handle itself, which results in the handle being rotatable about the vertical axis within a common horizontal plane, but this still fails to give the user the ability to rotate the handle into a position that may be more comfortable for the user, such as about a generally horizontal rotation axis. Similarly, such handles cannot be quickly or easily removed, re-installed and/or reoriented with respect to a body let alone a body already having other accessories attached thereto.

Consequently, a need exists for a handle that can be quickly installed, uninstalled, and reoriented/repositioned/rotated about a cylindrical body.

BRIEF DESCRIPTION OF THE DRAWINGS

Embodiments of the invention are illustrated in the figures of the accompanying drawings in which.

Elements in the figures are illustrated for simplicity and clarity and have not necessarily been drawn to scale or to include all features, options, or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Embodiments of a rotatable handle assembly are disclosed herein and include in at least one form a rotatable handle assembly comprising at least one mount, such as a clip member, and a handle connected thereto. The at least one clip member fits around a cylindrical object and includes an internal surface that mates to the cylindrical object and an external surface that includes a track or rail. The track or rail guides movement of the handle to permit the handle to rotate about a longitudinal axis of the cylindrical object. The handle includes an actuator having a braking member. The actuator is operable to move the braking member into a locked position or an unlocked position. The braking member comprising a braking surface that is movable into and out of contact with the track or rail. In an unlocked position, the braking surface is disengaged from the track or rail, or out of contact with the track or rail and the handle is movable relative to the track or rail, permitting the handle to rotate about a longitudinal axis of the cylindrical object. In a locked position, the braking surface is engaged with the track or rail, or in contact with the track or rail and movement of the handle relative to the track or rail is restricted. Additionally, the handle of the rotatable handle assembly is rotatable about a longitudinal axis of the handle. Rotating the handle about the longitudinal axis of the handle operates the actuator, causing the braking surface to move into and out of engagement or contact with the track or rail. The following figures and description provide further details relating to embodiments of the inventive subject matter as well as methods for using embodiments of the inventive subject matter.

Figure 1:
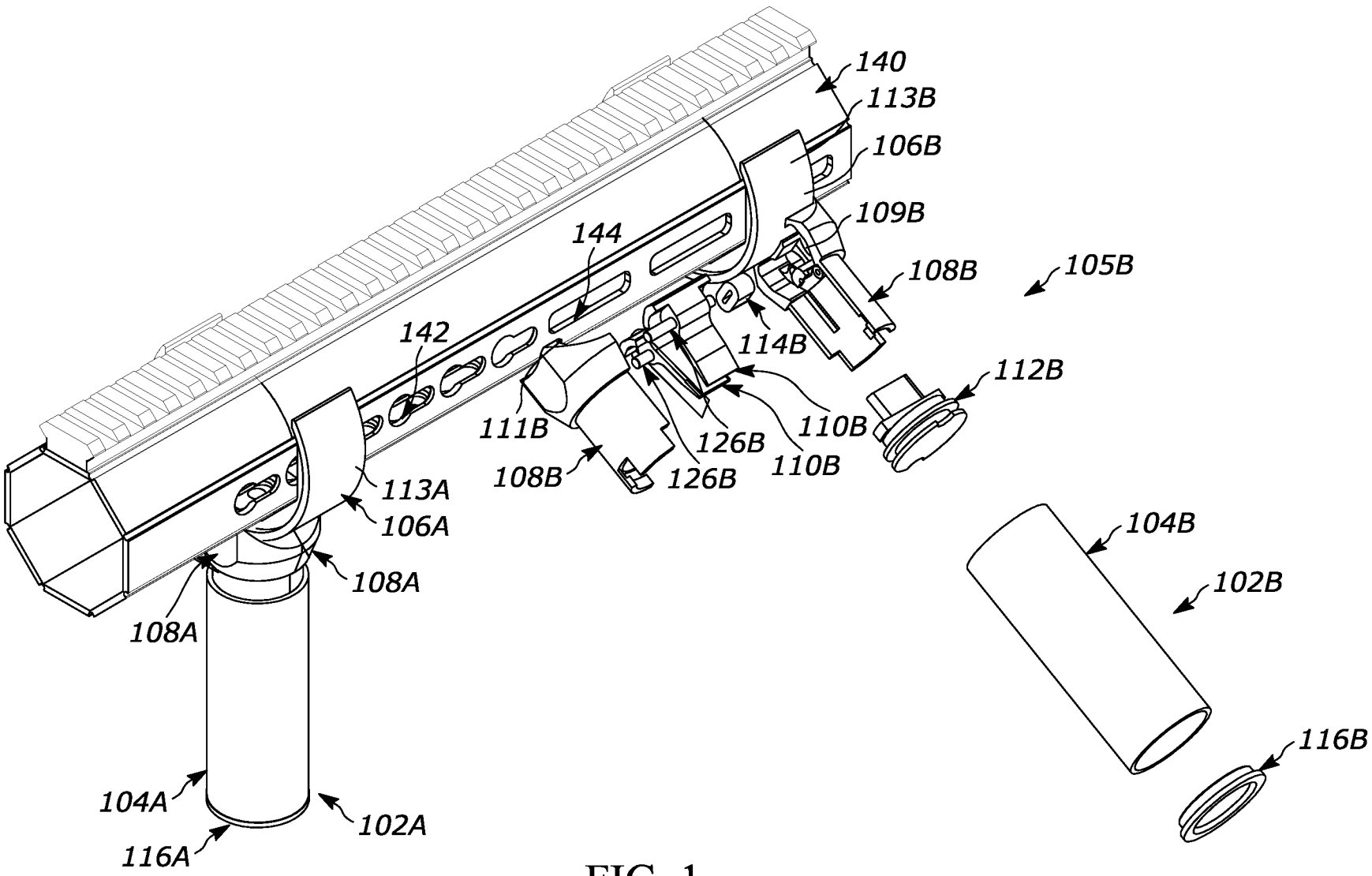
FIG. 1 depicts two handle assemblies 102A/102B in accordance with one form of the invention disclosed herein connected to a handguard of a weapon, with the first handle assembly 102A illustrating the handle fully connected to the handguard and the second handle assembly 102B being partially exploded in order to illustrate how the handle assembly is connected to the handguard.

FIG. 1 depicts two handle assemblies 102A/102B, according to some embodiments of the inventive subject matter. The handle assemblies 102A/102B are the same handle assembly but are depicted side-by-side in differing configurations or states of assembly to present aspects of the handle more clearly. The first handle assembly 102A is depicted in an assembled configuration and the second handle assembly 102B is depicted in a partially disassembled configuration and shown in a different position on the track or rail. The handle assembly 102A/102B is operable to mount to a tube or a cylindrical object 140, such as a handguard for a firearm. It should be understood, however, that the handle assembly 102A/102B is operable to mount other cylindrical objects as well as objects of varying shapes. In alternate embodiments the clip member 106A/106B could take any shape that allows the handle assembly 102A/102B to be fixed around an object. Thus, the handle assemblies 102A/102B may be used on objects other than cylindrical objects (such as posts, tubes, columns, etc.), rectangular structures, triangular structures, oval structures, etc.

Turning back to the embodiment of FIG. 1, the handle assembly 102A/102B includes a mount, such as clip member 106A/106B, an actuator 105B, and a handle 104A/104B. The clip member 106A/106B includes an inner surface with a geometry corresponding a tube or cylindrical object 140 and an external surface that includes an arcuate track 113A/113B. The actuator 105B includes a housing 108A/108B, a braking member 110B, a resilient member 114B, two pins 126B, and a cam member 112B (see FIGS. 3B and 4B for a detailed depiction of the actuator in an assembled configuration). The housing 108A/108B is comprised of two semi-cylindrical portions with at least one semi-cylindrical portion having a seat 109B that is configured to receive the resilient member 114B. A proximal end of the housing 108A/108B includes a lip 111B that mates with the track 113A/113B of the clip member 106A/106B. When the actuator is assembled, the two semi-cylindrical portions of the housing 108A/108B mate together around the braking member 110B and the resilient member 114B. More specifically, the resilient member 114B is nested in braking member 110B and is supported by the seat 109B. A proximal end of the cam member 112B is inserted into a distal end of the housing 108A/108B and engages or mates with the braking member 110B. The handle 104A/104B includes a proximal end with an annular opening having an internal diameter configured to mate with the external diameter of the housing 108A/108B. Thus, both semi-cylindrical portions can be mated together and inserted into the proximal end of the handle 104A/104B. The handle 104A/104B further includes a distal end having an annular opening that receives an end cap 116A/116B.

When the handle assembly 102A/102B is in an assembled configuration, the clip member 106A/106B secures the handle assembly 102A/102B to the cylindrical object 140. In the form illustrated, the cylindrical object 140 is a handguard for a firearm, such as an AR-15 rifle or the like. The internal surface of the clip member 106A/106B mates to the external surface of the cylindrical object 140. In some forms, the internal surface is configured to mate to standard mounting surfaces of the object 140. For example, the handle assembly 102A/102B is configured to mount to a conventional firearm rail interface, such as a standard KEYMOD 142 or M-LOK 144 handguard. When assembled, a proximal end of the actuator 105B is affixed to the track 113A/113B of the clip member 106A/106B. More specifically, the two semi-cylindrical portions of the housing 108A/108B mate together so that the lip 111B of the housing 108A/108B mates with the track 113A/113B. The distal end of the actuator 105B is inserted into a proximal end of the handle 104A/104B. End cap 116B is inserted in the opening at the distal end of the handle 104A/104B.

Figure 3A:
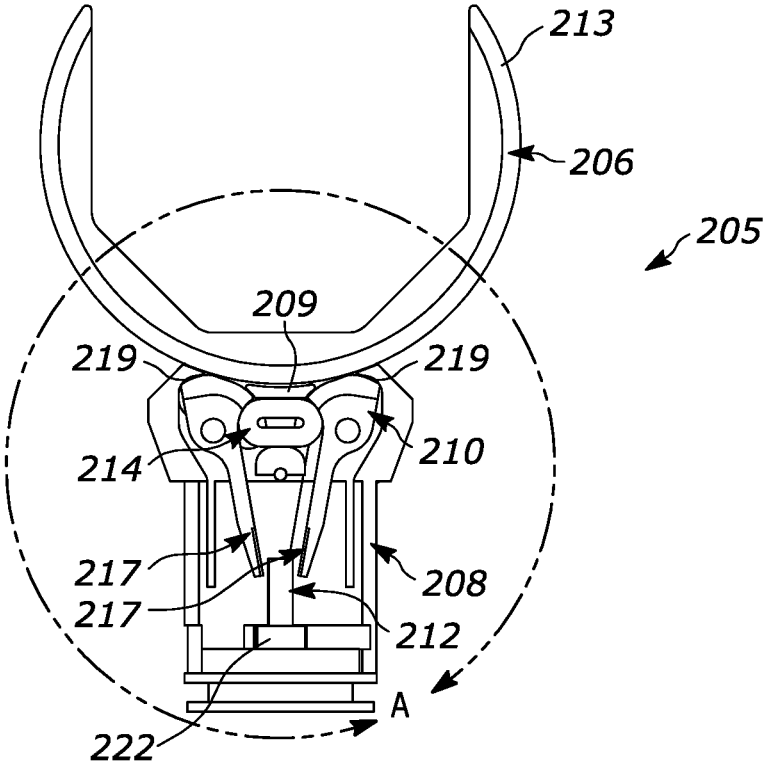
FIG. 3A is a front elevated view of the handle assembly 202 of FIG. 2 with a portion in cross-section to show the inner components of the handle with the handle in an unlocked state.
Figure 3A:
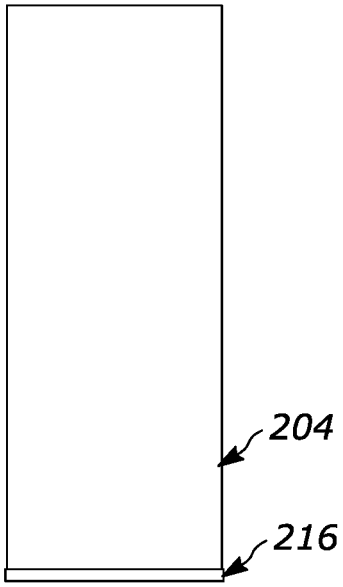
Figure 3B:
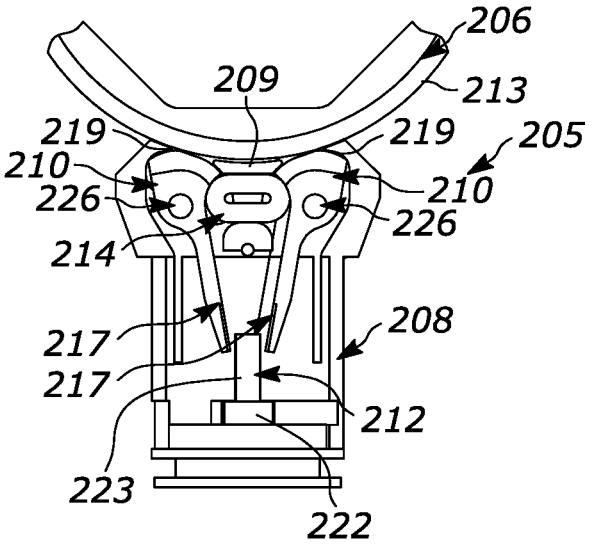
FIG. 3B is an expanded view of portion "A" of FIG. 3A.
Figure 4A:
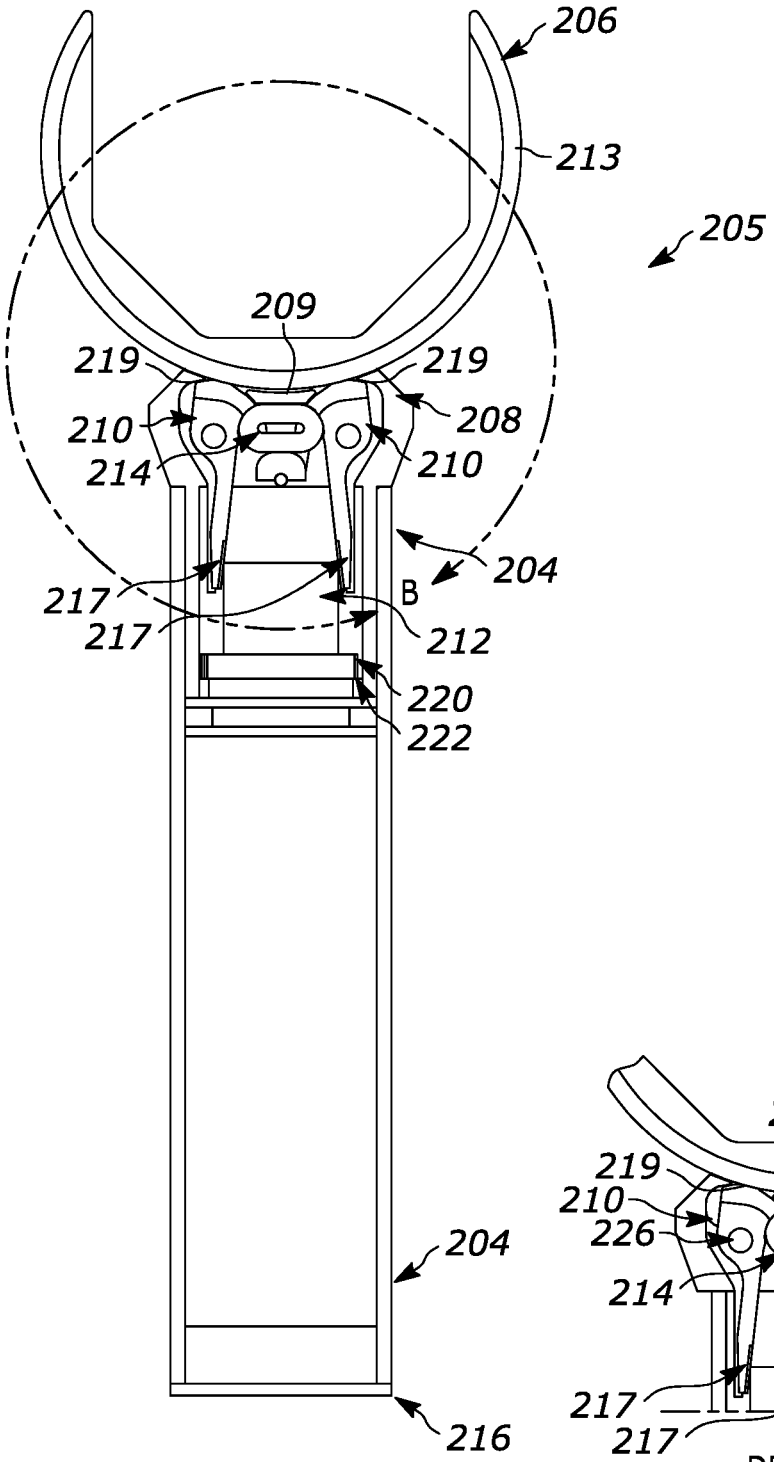
FIG. 4A is a front elevated view of the handle assembly 202 of FIG. 2 with a portion in cross-section to show the inner components of the handle with the handle in a locked state.
Figure 4B:
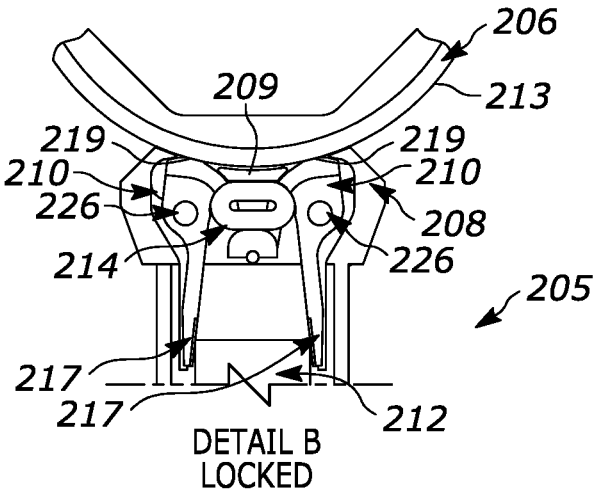
FIG. 4B is an expanded view of portion "B" of FIG. 4A.

In operation, the handle 104A/104B can be rotated about a longitudinal axis running along the handle to move the braking member 110B of the actuator 205B into a locked position or unlocked position. When in an unlocked position, the actuator 105B and the handle 104A/104B can slide along the track of the clip member 106A/106B and, thus, can be adjusted to a desired orientation about a longitudinal axis running through the cylindrical object 140. FIGS. 3A and 3B provide a detailed depiction of the handle assemble in an unlocked position. When in a locked position, the braking member 110B restricts movement of the handle assembly 102A/102B. FIGS. 4A and 4B provide a detailed depiction of the handle assembly in a locked position.

In some embodiments, such as the embodiment depicted in FIG. 1, the cylindrical object 140 to which the clip member 106A/106B is attached may be the handguard or fore grip of a firearm. As is depicted in FIG. 1, the clip member may be attached to the handguard or fore grip, for example, using a bolt or a nut of an M-LOK or KEYMOD mounting system. The bolt or nut can be inserted into an aperture of the clip member 106A/106B. Likewise, another end of the bolt or nut can be inserted into an aperture (i.e., keyhole 142, slot 144, etc.) on the cylindrical object 140 to secure the clip member 106A/106B to the cylindrical object. As depicted in FIG. 1, the cylindrical object may include one or more keyholes 142 or one or more slots 144. The particular attachment mechanisms for securing the clip member 106A/106B to the cylindrical object 140 discussed herein are not intended to be limiting. Other suitable attachment mechanisms may be used to facilitate the attachment of the clip member to the cylindrical object.

In some embodiments, the components of handle assembly 102A/102B will be made of metal, however, it should be understood that other materials such as plastics or other polymers may be used to manufacture one or more of the handle assembly components. In addition, in some embodiments, the handle 104A/104B may be provided with a grip, such as a surface texture formed in the outer surface on or an additional layer positioned over the exterior of the handle 104A/104B. In some embodiments, an elastomer or other material with a soft texture will be used and will include an ergonomic grip that makes the device easier to use. However, in preferred embodiments the grip will be ambidextrous to account for the fact that both left-handed and right-handed persons may use the handle assembly and/or that the handle assembly may be setup to be grabbed with a right-hand or left-hand (particularly in applications using two handle assemblies, each to be grabbed by one hand).

In some embodiments, the resilient member 114B may be made of a rubber material. For example, the resilient member 114B may be a rubber spring. However, any material with elastic resilience may be used, such as a steel spring.

While FIG. 1 and the associated text provide a brief overview of a handle assembly according to some embodiments of the inventive subject matter, FIGS. 2-7 provide further detail and explanation of an embodiment of a handle assembly in accordance with aspects of the invention disclosed herein. For convenience, items in FIGS. 2-7 that are similar to those discussed above with respect to FIG. 1 will be referenced using the same latter two-digit reference numeral but having a prefix "2" instead of "1". Thus, the handle assembly is referred to generally as handle assembly 202 and is similar to embodiments 102A/102B discussed above.

Figure 2:
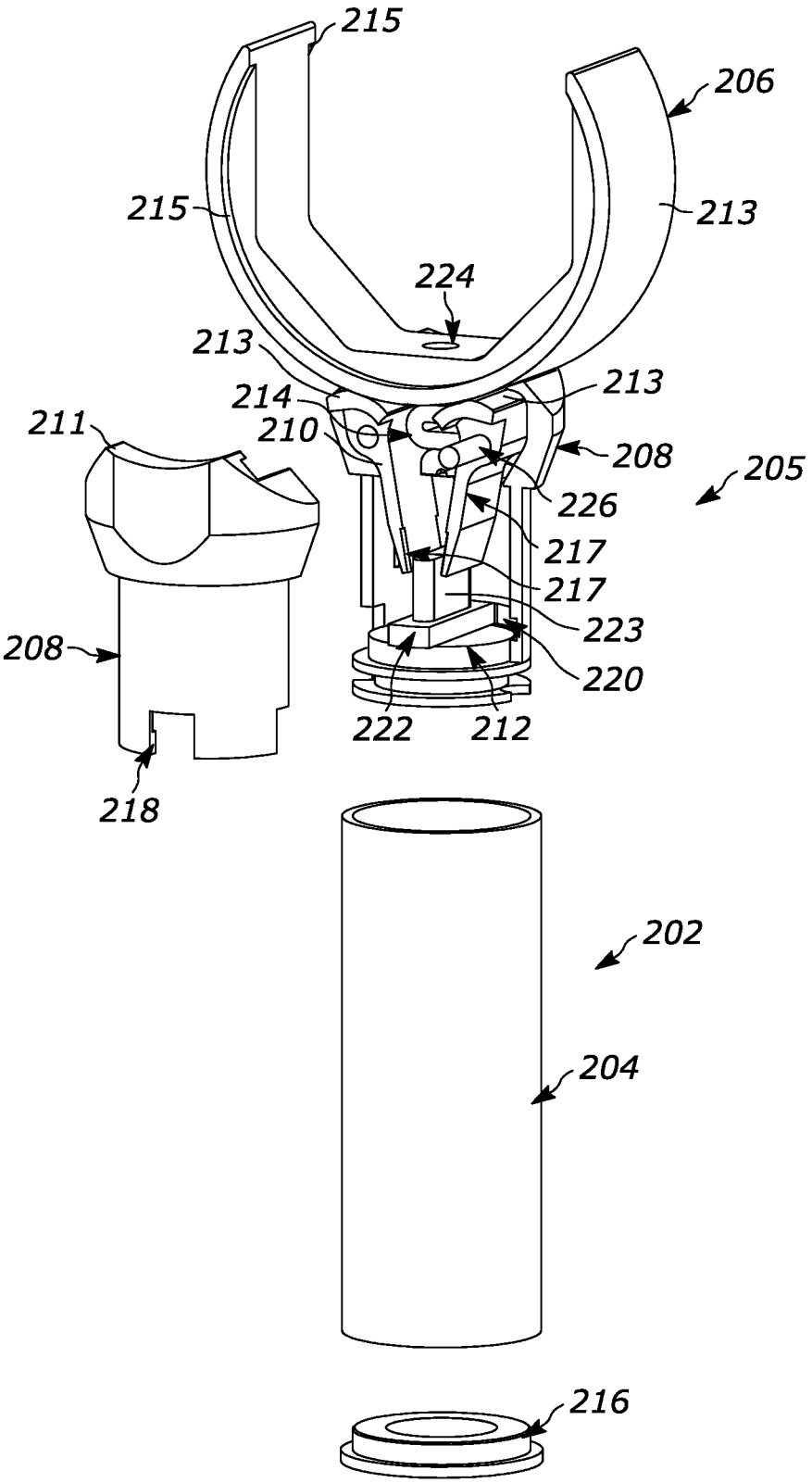
FIG. 2 is an exploded view of one form of handle assembly 202, according to some embodiments of the inventive subject matter.

FIGS. 2-7 depict several components of the handle assembly 202, according to some embodiments of the inventive subject matter. In FIG. 2, the handle assembly includes a mount, such as clip member 206, a handle 204, and an interstitial joint, such as actuator 205, which connects the handle to the mount. While the drawings of FIGS. 2-9 show the handle extending directly down from the mount in a six o'clock position, it should be understood that the handle can be rotated to loosen the actuator of the interstitial joint so that the handle can be rotated to other positions with respect to the mount (e.g., anywhere between a nine o'clock position and a three o'clock position with respect to the mount, one hundred eighty degrees of rotation, or semi-circular rotation, etc.).

As depicted in FIG. 2, the clip member 206 includes a track 213. The track 213 has an arcuate surface that runs along the external surface of the clip member. Grooves 215 extend along both sides of the track 213. Each groove 215 is configured to receive a corresponding lip 211 of the housing 208 of the actuator 205. The internal surface of the clip member 206 has a geometry corresponding to the perimeter of a cylindrical object to enable the clip member to be fixed around the perimeter of the cylindrical object. The internal surface of the clip member 206 further includes an aperture 224. The aperture 224 may be configured to receive, for example, a bolt or a nut for mounting the clip member to the cylindrical object. In some embodiments, the bolt or the nut may be part of an M-LOK or KEYMOD mounting system.

In some forms, the clip member 206 may have other shapes or configurations. For example, the clip member may be shaped to mate to the length of an object rather than to the perimeter of an object. Additionally, the clip member 206 may be shaped to mate to objects of varying shapes such as rectangular, square, hexagonal, etc. objects.

The actuator 205 depicted in FIG. 2, includes a housing 208 comprised of two complementary portions, a braking member 210, a resilient member 214, two pins 226, and a cam member 212. In the form shown, the two complementary portions of the housing 208 are semi-cylindrical in shape and mate together to form a cylinder. A proximal end of the housing 208 includes the lip 211 which mates with the groove 215 of the clip member 206. When assembled, the lip 211 and grooves 215 guide the motion of the actuator 205 and the handle 204 along the track 213. A distal end of the housing includes notches 218, 220. In the form shown in FIG. 2, notches 218 and 220 are positioned approximately ninety degrees apart. The braking member 210 and the cam member 212 are retained, at least in part, in the housing 208.

In the actuator 205 depicted in FIG. 2, the braking member 210 includes multiple components. Specifically, the braking member 210 includes two lever arms 217 having braking surfaces 219 at an end of each lever arm. The braking surfaces 219 are positioned adjacent to the track 213 of the clip member 206 so that the braking surfaces 219 can engage or come into contact with the track 213. Pins 226 are inserted into the lever arms 217, allowing the lever arms 217 to pivot about the pins 226. When the lever arms 217 pivot about the pins 226, the braking surfaces 219 are brought into and out of engagement or into and out of contact with the track 213. The resilient member 214 is seated between the pins 226 at an end of each braking surface 219. The resilient member 214 applies a force to the ends of each braking surface 219, biasing the braking surface 219 towards a position that is disengaged from or out of contact with the track 213. The cam member 212 is seated in the braking member 210 at the distal end of the housing 208. The cam member 212 includes a rectangular block 222 that supports an oblong-shaped cam 223. In the form depicted in FIG. 2, the cam 223 is oblong-shaped, however, it should be understood that a cam of other suitable shapes may be utilized. When the actuator is assembled, the oblong-shaped cam 223 is positioned between the lever arms 217 of the braking member 210.

The handle 204 depicted in FIG. 2 is cylindrical in shape and has an annular wall with openings at a proximal end and a distal end. The internal diameter of the opening at the proximal end of the handle 204 is complementary to the external diameter of the housing 208 so that a portion of the housing 208 can be inserted into the proximal end of the handle 204 in an assembled configuration. When assembled, the housing 208 is secured in the handle 204 via a friction fit connection between an inner surface of the handle 204 and an external surface of the housing 208. An end cap 216 is inserted into the opening at the distal end of the handle 204.

When the rotatable handle 202 depicted in FIG. 2 is assembled, the actuator of rotatable handle 202 can be operated by rotating the handle 204 about a longitudinal axis. Rotating the handle 204 also rotates the cam member 212 of the actuator 205. Upon rotation of the cam member 212, the oblong-shaped cam 223 engages or disengages the lever arms 217. More specifically, upon rotation of the cam member 212, the oblong-shaped cam 223 may come into or out of contact with the lever arms 217. When the oblong-shaped cam 223 comes into contact with the lever arms 217, the oblong-shaped cam 223 applies a force to the lever arms 217 that causes the lever arms 217 to separate or move apart. When the lever arms 217 move apart, the lever arms 217 pivot about the pins 226, causing the ends of the braking surface 219 to compress the resilient member 214. When the lever arms 217 come together or move towards one another, the lever arms 217 pivot about the pins 226, causing the ends of the braking surface 219 to decompress or relax the resilient member 214. In short, turning the handle 204 turns the cam member 212, which moves the braking surface 219 into or out of engagement or into or out of contact with the track 213 of the clip member 206.

One advantage of the handle assembly 202 depicted in FIG. 2 is that the handle assembly 202 can be attached to or detached from the cylindrical object without interfering with other uses of the object. For example, in the application where the cylindrical object is a fore grip or handguard for a rifle, the clip member 206 allows the handle assembly 202 to be connected to the fore grip or handguard of the rifle without requiring removal of any accessories mounted on the fore group or handguard such as Picatinny rails or even accessories mounted on or to such rails such as scopes, laser sights, lights, etc. Furthermore, the design of the clip member 206 allows minimal interference with accessories that may be mounted to an opposing side of the fore grip or handguard of the rifle. For example, the clip member 206 may be mounted to the bottom of the handguard without interfering with another accessory mounted to the top of the handguard.

Turning to FIGS. 3A-4B, a detailed depiction of the actuator 205 in a locked and unlocked position is provided. FIGS. 3A-4B illustrate operation of the handle assembly 202, more particularly how the handle 204 operates the actuator 205 of the handle assembly 202.

FIG. 3A depicts a front elevated view of the handle assembly 202 in a semi-assembled state with the actuator 205 in an unlocked position, according to some embodiments of the inventive subject matter. In FIG. 3A, end cap 216 is inserted into an opening at the distal end of the handle 204. Turning to the actuator 205, the braking member 210 and resilient member 214 are seated in the housing 208 of the actuator 205. The seat 209 of the housing 208 holds the resilient member 214 within braking member 210. The cam member 212 is positioned in a distal end of the housing 208 between the lever arms 217 of the braking member 210. In the unlocked position, the oblong-shaped cam 223 is positioned parallel to the lever arms 217 or in a position wherein the oblong-shaped cam 223 is not applying a force to lever arms 217. Additionally, in the unlocked position, the rectangular block 222 of the cam member 212 is aligned with notch 218 of the housing 208. Expanded portion "A" of FIG. 3A is provided in FIG. 3B to better show the interaction between the cam member 212 and the braking member 210 in an unlocked position.

More particularly, FIG. 3B depicts an expanded portion of the actuator 205 of handle assembly 202 in an unlocked position (detail "A" of FIG. 3A). In the unlocked position, the braking surface 219 is disengaged from or out of contact with the track 213. When the braking surface 219 is disengaged from or out of contact with the track 212, the braking surface is not applying a braking force to the track 213 so that the actuator 205 and handle 204 can move along the track 213. Additionally, in the locked position depicted in FIG. 3B, the oblong-shaped cam 223 and rectangular block 222 are in parallel alignment with lever arms 217. When the oblong-shaped cam 223 is in parallel alignment with the lever arms 217, the lever arms 217 are close together and the resilient member 214 is relaxed or uncompressed. When the resilient member is relaxed or uncompressed, it exerts force on the ends of the braking surfaces 219, biasing the lever arms 217 towards each other. When the actuator 205 is in an unlocked position as is depicted in FIG. 3B, the handle 204 attached to actuator 205 is movable relative to the track 213, permitting the handle 204 to rotate about a longitudinal axis of the cylindrical object to which the handle assembly is attached.

FIG. 4A depicts a front elevated view of the handle assembly 202 in a semi-assembled state with the actuator 205 in a locked position, according to some embodiments of the inventive subject matter. In FIG. 4A, end cap 216 is inserted into an opening at the distal end of the handle 204. Turning to the actuator 205, the braking member 210 and resilient member 214 are seated in the housing 208 of the actuator 205. The at least one seat 209 of the housing 208 holds the resilient member 214 within braking member 210. The cam member 212 is positioned in a distal end of the housing 208 between the lever arms 217 of the braking member 214. In the locked position, the oblong-shaped cam 223 is positioned perpendicular to the lever arms 217. Additionally, in the locked position, the rectangular block 222 of the cam member 212 is aligned with notch 220 of the housing 208. Expanded portion "B" of FIG. 4A is provided in FIG. 4B to better show the interaction between the cam member 212 and the braking member 210 in a locked position.

More particularly, FIG. 4B depicts an expanded portion of the actuator 205 of the handle assembly 202 in an locked position (detail "B" of FIG. 4A). In the locked position, the braking surface 219 engages or contacts the track 213. When the braking surface 219 engages or contacts the track 212, the braking surface 219 applies a braking force to the track 213 so that the actuator 205 and handle 204 cannot move along the track 213. The oblong-shaped cam 223 and rectangular block 222 are aligned perpendicular or at an angle of less than ninety degrees relative to the lever arms 217. When the oblong-shaped cam 223 is positioned perpendicular to the lever arms 217 or is positioned at an angle of less than ninety degrees relative to the lever arms 217, the lever arms 217 are moved apart. When the lever arms 217 are moved apart, lever arms 217 pivot about the pins 226 causing the braking surfaces 219 to move into engagement or contact with track 213. When the braking surfaces 219 move into engagement or contact with track 213, the ends of the braking surfaces 219 compress the resilient member 214. When the actuator 205 is in a locked position as is depicted in FIG. 4B, the handle 204 attached to actuator 205 is in a fixed position along the track 213. Engagement of the braking surface 219 with the track 213 as shown in FIG. 4B prevents the handle 204 from rotating about a longitudinal axis of the cylindrical object to which the handle assembly is attached.

Figure 5A:
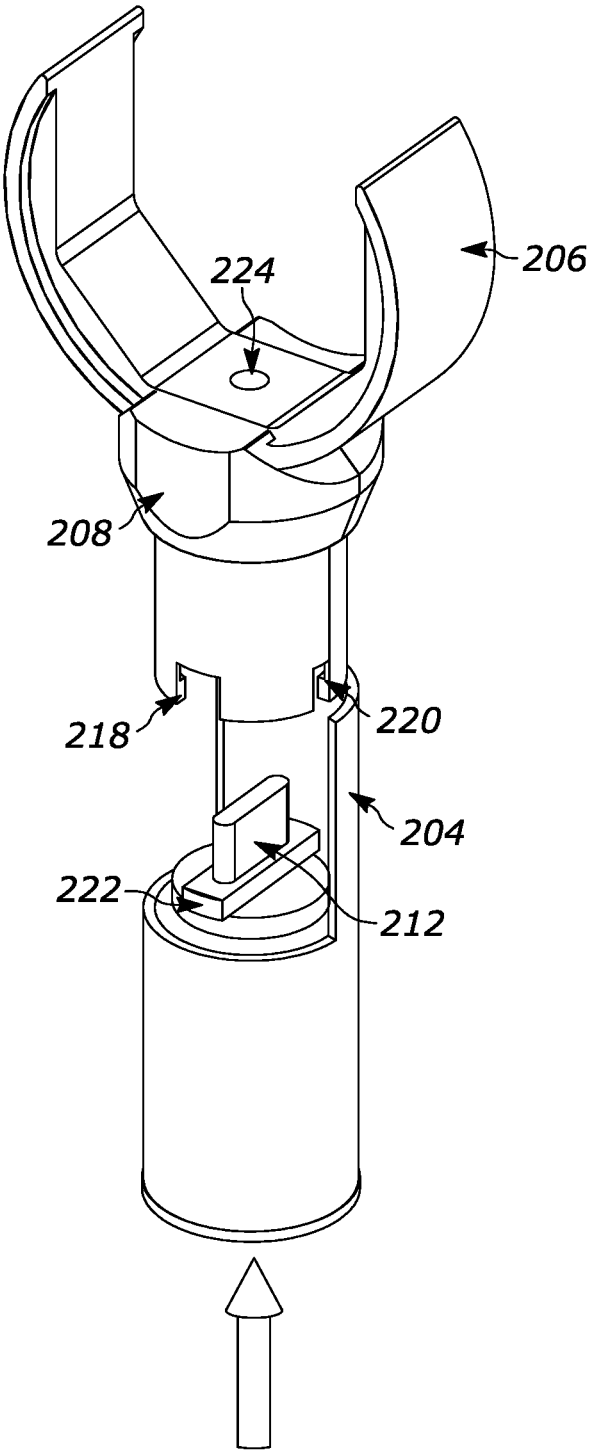
FIG. 5A is a partially exploded view of the handle assembly 202 of FIG. 2.

FIG. 5A depicts a partially exploded view of the handle assembly 202 of FIG. 2. As depicted in FIG. 5A, the handle assembly 202 can be assembled by sliding the handle 204 over the housing 208 so that at least a portion of the housing 208 is positioned with the handle 204. More specifically, when the two complementary portions of the housing 208 mate together on the clip member 206, the housing 208 can be inserted into a proximal end of the handle 204. The handle 204 holds the two complementary portions of the housing 208 together in a unitary configuration, retaining them in position on the clip member 206. Furthermore, when assembled, cam member 212 is securely fixed inside the handle 204 so that rotation of the handle about a longitudinal axis of the handle 204 causes rotation of the cam member 212.

As illustrated in FIG. 5A, the housing 208 can be inserted into or removed from handle 204 via the application of manual pressure. Because the housing 208 is removable from the handle, the handle assembly 202 can be easily assembled and/or disassembled. Additionally, the form illustrated in this embodiment, the handle 204 can be easily removed replaced. In some embodiments, interchangeable handles can be provided. The interchangeable handles can also be configured to mate to the housing 208 and cam member 212 so that the interchangeable handles cooperate with the actuator of the handle assembly. Additional interchangeable handles can be provided that include, for example, alternative grips or varied handle lengths.

Figure 5B:
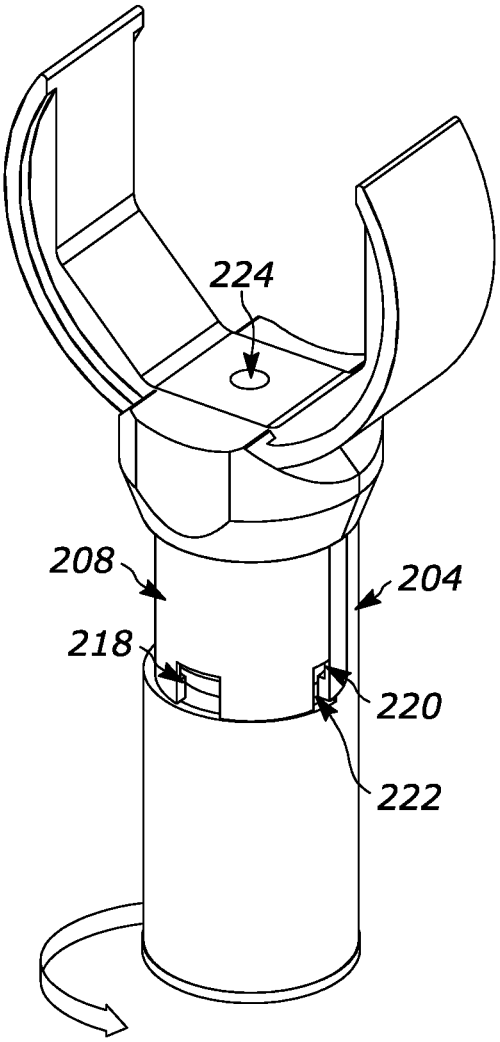
FIG. 5B is a partially cutaway view of the handle assembly 202 of FIG. 2 illustrating the operation of the handle.

FIG. 5B depicts a partially cutaway view of the handle assembly 202 of FIG. 2, illustrating the operation of the actuator of the handle assembly. As depicted in FIG. 5B, the handle 204 can be rotated about a longitudinal axis of the handle 204. When the handle 204 is rotated, the housing 208 remains in a fixed position on the clip member 206. Rotating the handle 204 approximately ninety degrees about a longitudinal axis places the rectangular block 222 of the cam member 212 into alignment with either notch 218 or notch 220 on the housing 208. In the form depicted in FIG. 5B, the rectangular block 222 is aligned with notch 220, placing the handle assembly 202 into a locked position as depicted in FIGS. 4A and 4B. As previously described with reference to FIGS. 3B and 4B, rotation of the handle 204 place the actuator 205 of the handle assembly 202 into a locked position or an unlocked position. Specifically, rotation of the handle 204 moves the braking surfaces 219 of the braking member 210 into or out of engagement or into or out of contact with the track 213 of the clip member 206. Thus, a user of the handle assembly can rotate of the handle 204 about a longitudinal axis to operate the actuator, either to fix the handle assembly along track 213 (i.e., in a locked position) or to move the handle assembly along track 213 (i.e., in an unlocked position).

Figure 6:
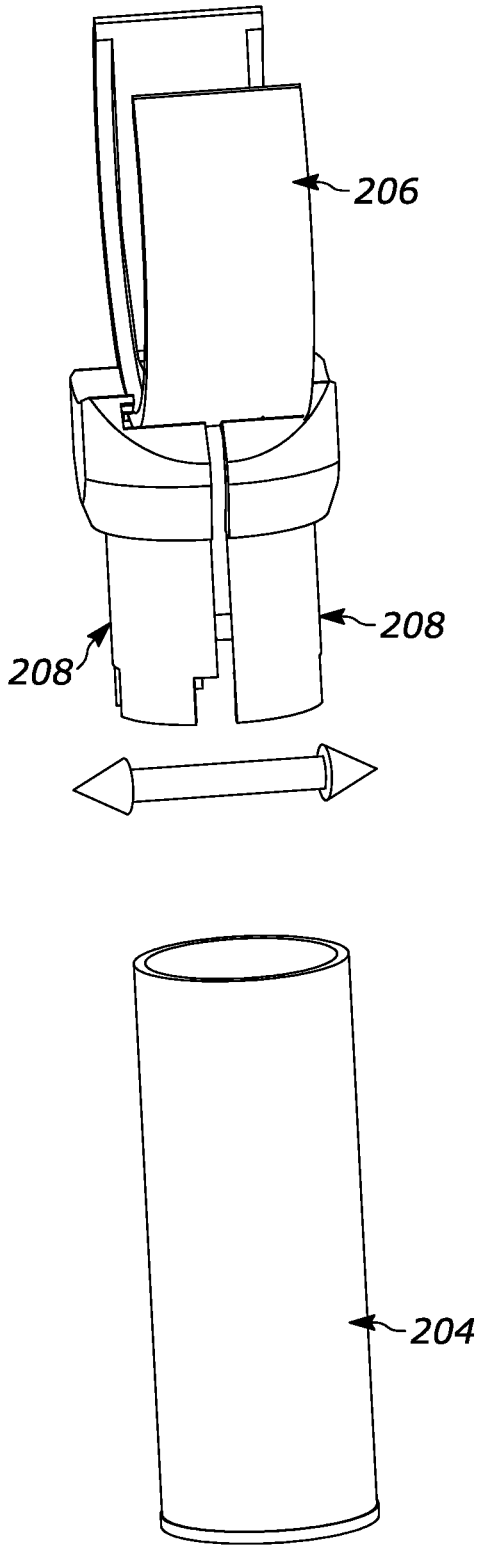
FIG. 6 is an exploded view of the handle assembly 202 of FIG. 2.

FIG. 6 depicts an exploded view of the handle assembly 202 of FIG. 2. As shown in FIG. 6, the two complementary portions of the housing 208 can be separated when the housing 208 is removed from the handle 204. Separation the two complementary portions allows the housing 208 to be detached from the clip member 206. After the housing 208 has been detached from the clip member 206, the clip member 206 can be removed from the cylindrical object. As discussed above, removal of the clip member from the cylindrical object may involve, for example, un-bolting the clip member from the cylindrical object. In this form, the handle assembly 202 can be easily attached to or detached from a cylindrical object.

Figure 7:
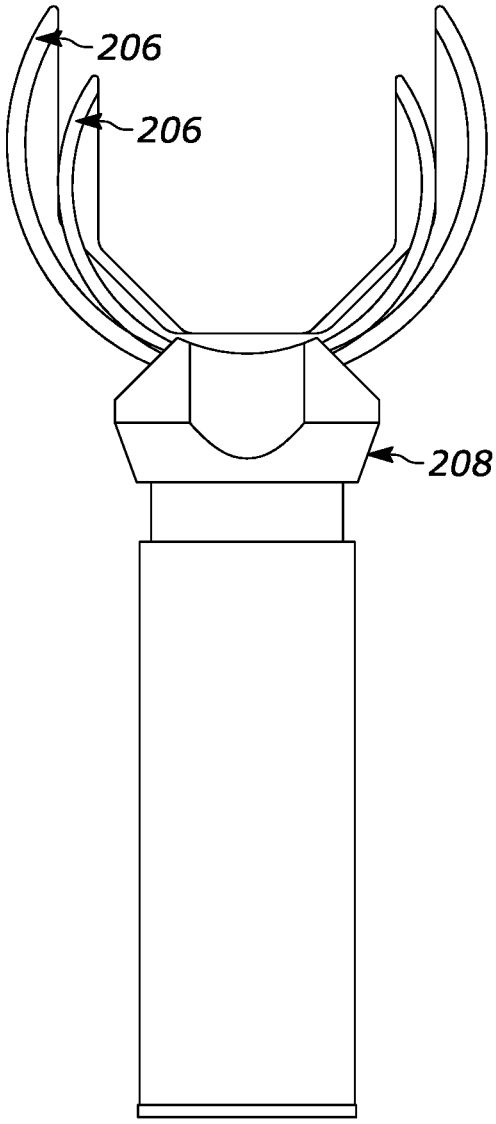
FIG. 7 is a front elevated view of the handle assembly 202 of FIG. 2 illustrating a plurality of different sized clip members.

FIG. 7 depicts a front elevated view of the handle assembly 202 of FIG. 2 illustrating a plurality of different sized clip members. In the two forms shown in FIG. 7, the handle assembly may include clip members 206 having varying diameters. Varying the diameter of the clip member 206 allows the handle assembly to be attached to cylindrical objects of varying diameters. In some embodiments, the internal surface of the clip member 206 may have a different geometry so that the clip member can mate to objects of various shapes such as objects having rectangular, square, hexagonal, etc. perimeters. Additionally, as shown in FIG. 7, the tracks on the external surface of the clip members 206 have the same width so that the housing 208 can mate to either clip member 206. Thus, a single housing 208 can be interchanged with various clip members 206 to allow the handle assembly 202 to be affixed to various objects.

In a brief summary, the adjustable handle for a firearm disclosed herein can alternatively be said to comprise a mount (e.g., 105, 205, etc.) for connecting the adjustable handle assembly to at least a portion of the firearm, and a handle (e.g., 104, 204, etc.) connected to the mount with an interstitial joint (e.g., 105, 205, etc.), the handle being rotatable in a first direction to clamp the handle in position with respect to the mount, and rotatable in a second direction opposite the first to unclamp the handle from the mount such that the handle can be repositioned about the mount to a desired position before being secured in position by rotating the handle in the first direction again. In a preferred form, a semi-circular range of movement can be made with the handle such that it can be clamped to the mount in any position within an one-hundred eighty degrees range.

In the form shown, the interstitial joint of the adjustable handle comprises two jaws positioned opposite one another wherein at least one of the jaws moves toward the other jaw when the handle itself is rotated about its longitudinal axis in the first direction and away from the other when the handle is rotated about its longitudinal axis in the second position. Thus, the jaws clamp to and release from the track or rail defined by the mount. In a preferred form, both jaws will move toward one another so that less rotation of the handle along its longitudinal axis is required in either direction to either clamp or release the adjustable handle assembly.

While the embodiments up to now have shown a clamp type arrangement where the jaws move toward one another or at least one toward the other, it should be understood that the opposite configuration, e.g., a spreader type configuration, could be used to cause frictional engagement between the handle and the mount. For example the jaw members could have protrusions that mate with inward facing recesses (the openings of which face each other) such that rotation of the handle in one direction would make one or more of the jaws to move apart from the other (or away from the other) thereby causing the jaws to frictionally engage the inward facing recesses to secure the handle in frictional engagement with the mount via the interstitial joint. Then the handle could be operated in the opposite direction causing one or more of the jaws to move toward one another thereby releasing the handle so that it can be repositioned about the mount to accommodate a different handle grip orientation.

In the forms shown herein, the adjustable handle connects to the firearm in a multi-point connection configuration. For example, in some forms it is an at least two point connection with the first point of connection being located on the mount and being comprised of a KEYMOD or M-LOK firearm rail interface (e.g., located on the jaws of the mount or clip) and the second point of connection also being on the mount but at the interstitial joint causing a frictional engagement between the handle and the mount to allow the handle to be adjusted about the KEYMOD or M-LOK firearm rail(s) without having to disconnect the handle from the KEYMOD or M-LOK firearm rail(s).

Applicant has applied for another rotating firearm handle in U.S. application Ser. No. 15/295,788, filed Oct. 17, 2016 entitled Rotating Handle and Related Methods and U.S. application Ser. No. 16/653,678 filed Oct. 15, 2019 entitled Rotating Handle and Related Methods, which both claim priority to U.S. Provisional Patent Application No. 62/242,637 filed Oct. 16, 2015 entitled Rotating Handle and Related Methods, and hereby incorporates these applications by reference in their entirety.

Figure 8:
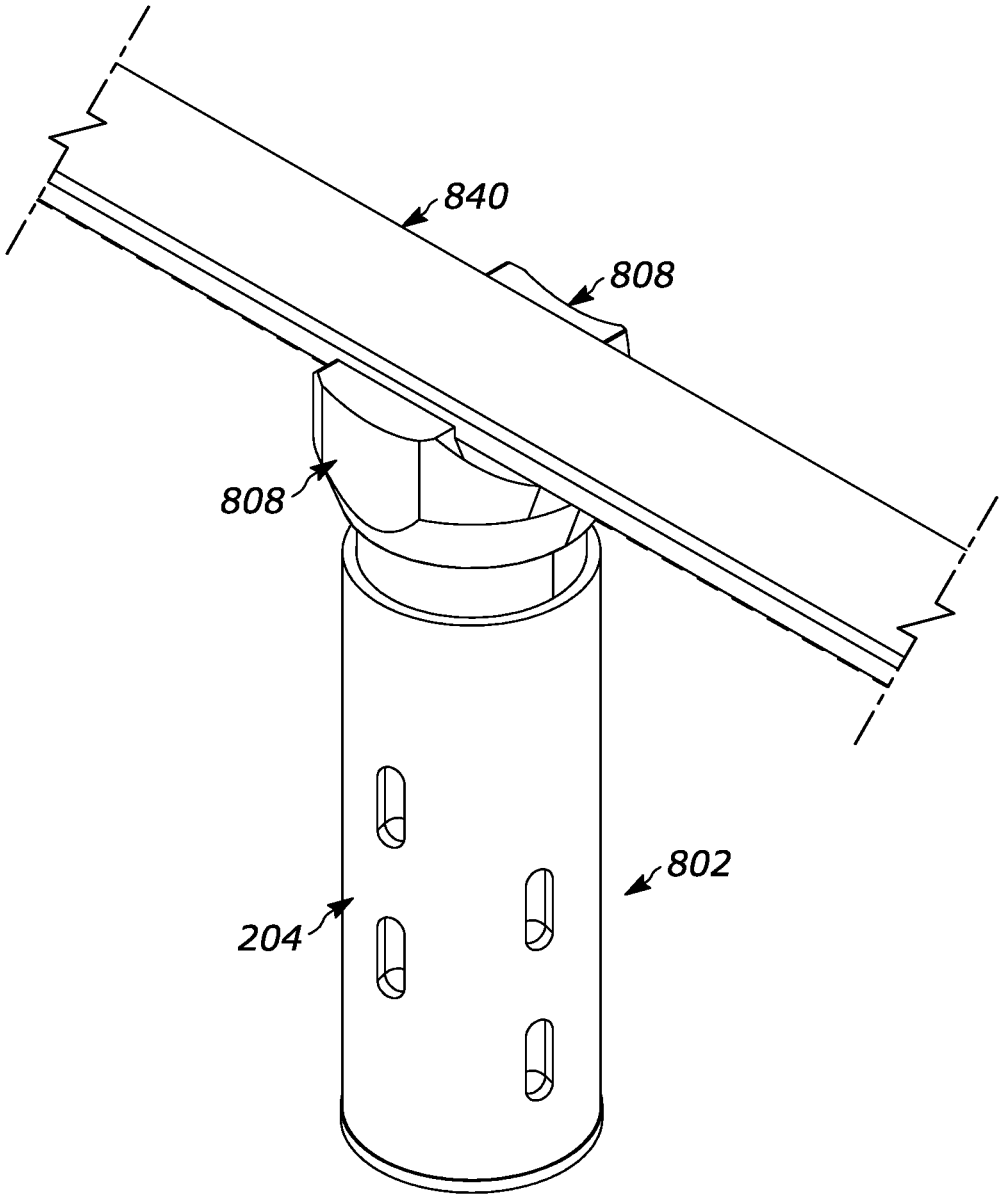
FIG. 8 is a perspective view of a movable handle assembly 802.
Figure 9:
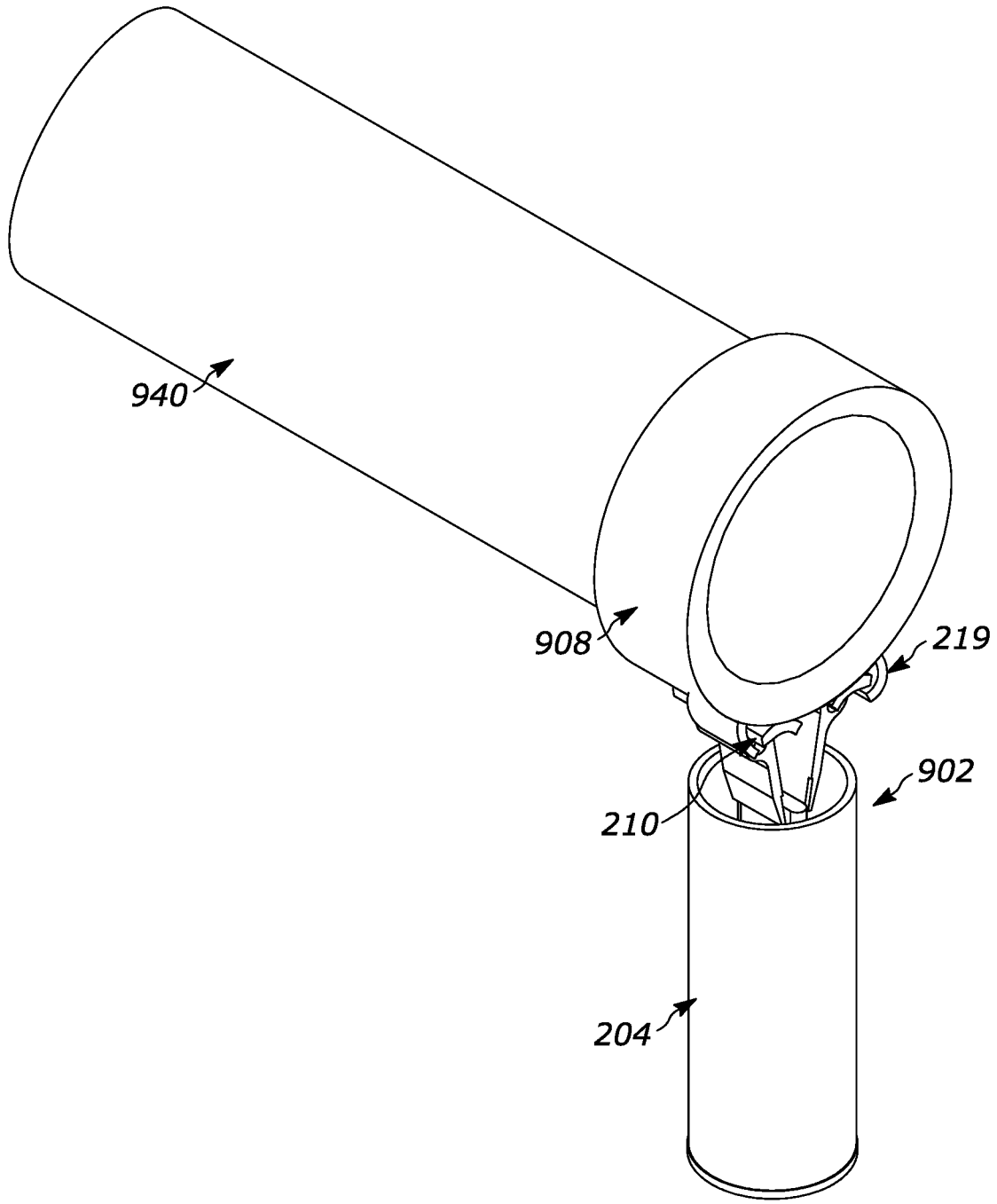
FIG. 9 is a perspective view of a movable handle assembly 902.

Turning to FIGS. 8 and 9, additional embodiments of the handle assembly are depicted. In some embodiments, the housing of the handle assembly may be directly affixed to an object, permitting the actuator to operate to the braking surface to engage or contact the surfaces of the object. In some embodiments, the housing of the actuator may take other forms, such as a circular form that is affixed directly to the object rather than to a clip member that attaches to the object.

FIG. 8 depicts a movable handle assembly 802. In the embodiment depicted in FIG. 8, the housing 808 may be directly affixed to a rail 840. In some forms the rail 840 may be a Picatinny rail that is mounted to the fore grip or handguard of a firearm. The movable handle assembly 802 includes a housing 808 and a handle 204 as described with reference to FIG. 2. The movable handle assembly 802 also includes an actuator, the components of which are the same as those described with reference to the actuator 205 of FIG. 2. In the form depicted in FIG. 8, a clip member is not required. Rather, the housing is affixed directly to the rail 840 on the object rather than to a clip member that is attached to the object. The housing 808 affixes the movable handle assembly 802 to the rail 840. Specifically, the two complementary portions of the housing 808 mate together along the rail 840. Once the movable handle assembly 802 attached to the rail 840, the handle 204 can be rotated about a longitudinal axis of the handle 204. Rotating the handle 204 causes a braking surface of the actuator to engage or disengage or come into or out of contact with the rail 840. When the braking surface is disengaged or out of contact with the rail, the movable handle assembly 802 can slide forward and rearward on the rail 840. When the braking surface engages or is in contact with the rail, the movable handle assembly 802 is retained in a fixed position along the rail 840. By some approaches, the housing 808 can be configured to mate to either a rail 840 or to a clip member, such as the clip member 206 described with reference to FIG. 2, so that the housing is interchangeable with the rail 840 or the clip member.

FIG. 9 depicts another embodiment if a movable handle assembly 902. In the embodiment depicted in FIG. 9, the movable handle assembly 902 is affixed to a cylindrical object 940. The movable handle assembly 902 includes a housing 908 and a handle 204. A proximal end of the housing includes a ring that is configured to mate directly to the cylindrical object 940. A braking member 210 is contained in the housing 908. The braking member 210 is the same as described with reference to the braking member 210 of FIG. 2. Also, similar to the housing in FIG. 2, when assembled, the distal end of the housing engages or contacts a cam member and is seated in an opening of the handle 204. As depicted in FIG. 9, a braking surface 219 of the braking member 210 is adjacent to the surface of the cylindrical object. Thus, the braking surface 219 can directly engage or contact the surface of the cylindrical object 940. More specifically, rotating the handle 204 about a longitudinal axis causes the braking surface 219 of the braking member 210 to either engage or disengage or come into or out of contact with the surface of the cylindrical object 940. When the braking surface is disengaged or out of contact with the surface of the cylindrical object 940, the handle 204 can be rotated 360 degrees about a longitudinal axis of cylindrical object 940.

Figure 10A:
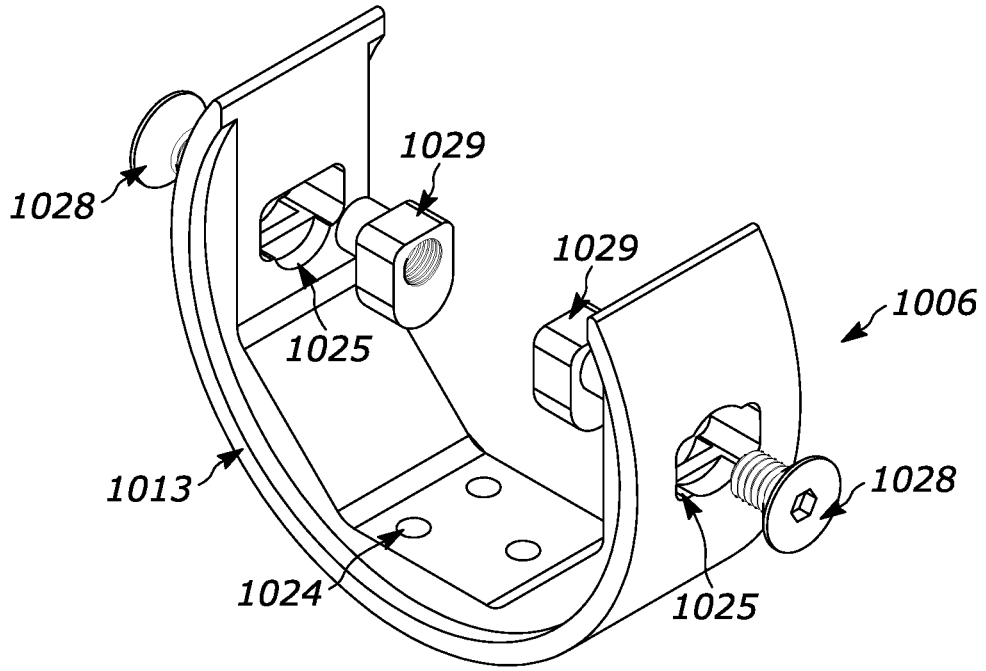
FIG. 10A is a top perspective view of a clip member 1006 in accordance with one form of the invention.
Figure 10B:
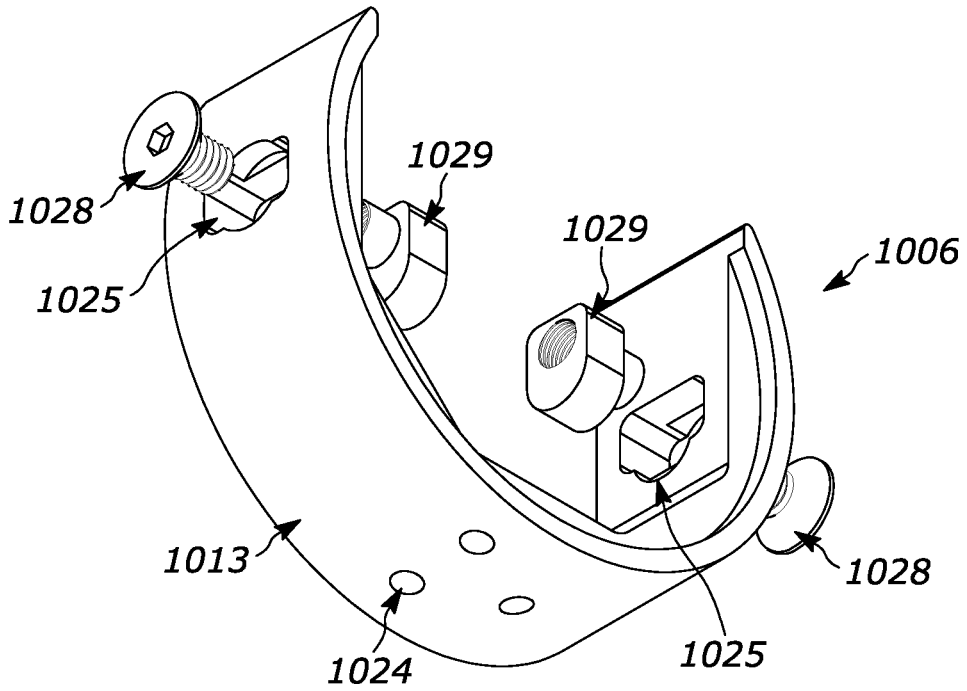
FIG. 10B is a bottom perspective view of a clip member 1006 in accordance with one form of the invention.

FIG. 10A depicts a top perspective view and FIG. 10B depicts a bottom perspective view of a clip member 1006 for a movable handle assembly. The clip member 1006 is another embodiment of the clip member 206 depicted in FIG. 2. In the embodiment depicted in FIGS. 10A and 10B, clip member 1006 includes apertures 1024 at the bottom of the clip member 1006 and two openings 1025 on opposing sides of the clip member 1006. The apertures 1024 may include threading to receive, for example, a bolt. The openings 1025 may be configured to receive an attachment mechanism, such as screw 1028 for a KEYMOD mounting system. The apertures 1024 and openings 1025 may be used to attach the clip member 1006 to a cylindrical object, such as the handguard for a firearm, via the screw 1028 and nut 1029. To secure the clip member 1006 to a handguard for a firearm, the nut 1029 may be received by a corresponding keyhole 142 on the handguard (see, e.g., keyhole 142 in FIG. 1). Alternatively, nuts 1029 shaped to mate with an M-LOK mounting system can be used. The screw 1028 and M-LOK or KEYMOD nut 1029 are substantially similar to those to be used to mount the clips of the previous embodiments. The clip member 1006 also includes a track 1013. An actuator and handle of the movable handle assembly, such as the actuator 205 and handle 204 depicted in FIG. 2, can be secured along the track 1013 of the clip member 1006. The track 1013 guides movement of the actuator and handle of the movable handle assembly about a longitudinal axis of the cylindrical object to which the clip member 1006 is attached.

The clip member may be attached to the cylindrical object using a variety of attachment mechanisms, for example, using screws and nuts having a variety of configurations. For example, an M-LOK mounting system, including an M-LOK screw and M-LOK T-nut, may be used to secure the clip member 1006 to a fore grip or handguard for a firearm. By some approaches, the openings 1025 depicted in FIGS. 10A and 10B may be configured to receive the M-LOK screw. To secure the clip member 1006 to a handguard for a firearm, the M-LOK screw may be inserted into opening 1025 and the M-LOK T-nut may be received by a corresponding slot 144 on the handguard of a firearm (see, e.g., slot 144 in FIG. 1). It should be understood that the clip member may be configured to mate to other suitable mounting systems or rail accessory systems for connecting accessories to the fore grip or handguard for a firearm, such as Picatinny rails, Weaver rail mounts, Dovetail rails, or NATO accessory rails. Furthermore, in some embodiments, the clip member may include more than two openings for attaching the clip member to the cylindrical object. In other embodiments, the clip member may include a single opening for attaching the clip member to a cylindrical object.

While a rotatable handle assembly has been discussed thus far, it should be understood that such a feature can be implemented in many different types of products and that those end products are contemplated as inventions disclosed herein. For example, the handle assembly can be attached to a support member of a cart, such as the frame of a dolly. In other examples, the handle assembly may be secured on a bar on a piece of fitness equipment, on a power tool such as a drill or a hammer drill, or on a mobility aid such as a walking aid (e.g., crutch, brace, cane, walker, etc.). In these additional exemplary implementations, the handle assembly can be tightened and loosened as described throughout this specification. When loosened, the position of the handle assembly can be altered (e.g., repositioned, reoriented, etc.) as desired. It should be understood that the implementations may include one or more of such handle assemblies as desired.

In addition to the above embodiments, it should be understood that various methods are also disclosed herein such as methods for securing an handle to an object and methods of providing a repositionable or reorientable handle that can be adjusted in a least two, and in some forms three, directions and/or along at least two separate axes of rotation and/or in two different planes along one of those axes of rotation.

Figure 11:
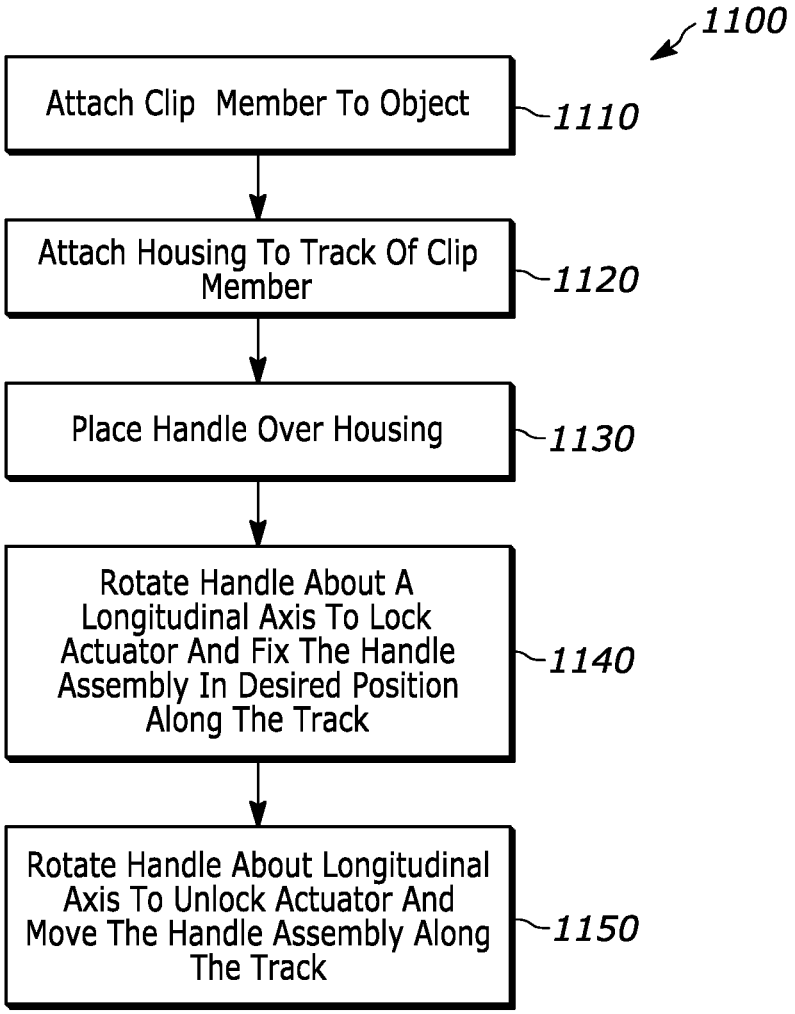
FIG. 11 is a flow diagram depicting example operations for a method of using a rotatable handle assembly as disclosed herein.

In FIG. 11, a flow diagram depicting example operations for a method 1100 of using a rotatable handle assembly is illustrated. In some forms, the method may begin at step 1110 wherein the clip member may be attached to an object. In some embodiments, the clip member may be attached to a cylindrical object, such as the fore grip or handguard for a rifle as depicted in FIG. 1. The clip member may be attached to the object using a bolt or a nut. By some approaches, the clip member is attached via an M-LOK or KEYMOD attachment mechanism.

A c-shaped clip member as depicted in FIGS. 2-7 may provide advantages at step 1110. For example, in the rifle fore grip or handguard application discussed above, a c-shaped clip member can be affixed to a side of the handguard without requiring removal of other accessories mounted to another side of the fore grip or handguard such as Picatinny rails or accessories mounted to a Picatinny rail such as scopes, laser sights, lights, etc.

At step 1120, an actuator housing for the rotatable handle assembly is attached to the clip member. As discussed above, the housing may be comprised of multiple complementary portions that mate together to fit around a track of the clip member. Additional parts of the actuator may be held within the housing, these parts may be used to operate the rotatable handle assembly once the rotatable handle assembly has been positioned on the object. Once the housing is attached to the track of the clip member, the housing (and parts contained therein) of the rotatable handle assembly can slide along the track of the clip member.

In some alternative embodiments, the actuator housing may be attached directly to a portion of an object and therefore the clip member is not required. For example, the housing may be attached directly to a Picatinny rail of a rifle. By this approach, multiple portions of the housing can mate together to fit around the Picatinny rail. When the housing is attached directly to the object, the method starts at step 1120 rather than at step 1110.

After the housing has been attached to the track, at step 1130, a handle can be placed over the housing. The handle may, for example, slide over at least a portion of the housing to secure the multiple complementary portions of the housing together. Once assembled, the housing may be secured within the handle via a friction fit connection. In an assembled configuration the handle is capable of rotating about a first axis of rotation and a second axis of rotation. For example, the first axis of rotation may be a longitudinal axis running along the handle. The second axis of rotation may be a longitudinal axis running along the object to which the handle is attached. The second axis of rotation may be, for example, along the track of the clip member.

At step 1140, the handle may be rotated about the longitudinal axis running along the handle (i.e., the first axis of rotation) to lock the actuator of the rotatable handle assembly and fix the handle in a desired position along the track. Rotating the handle about the longitudinal axis running along the handle operates the actuator of the rotatable handle assembly. Rotating the handle assembly in one direction may unlock the actuator, while rotating the handle assembly in another direction may lock the actuator. When the actuator is locked, a braking mechanism of the actuator engages or contacts the track and fixes the rotatable handle assembly in a position along the track.

At step 1150, the handle may be rotated about a longitudinal axis running along the handle (i.e., the first axis of rotation) to unlock the actuator and move the handle assembly along the track. When the actuator is unlocked, the braking mechanism of the actuator disengages or comes out of contact with the track and frees the rotatable handle assembly so that it can slide along the track. When unlocked, the rotatable handle assembly can rotate about the longitudinal axis running along the object to which the handle is attached (i.e., the second axis of rotation). For example, when unlocked, the rotatable handle assembly can move along the track which allows the assembly to rotate about the second axis of rotation.

It should be understood that in some embodiments, additional features may be added to the rotatable handle assembly. For example, in some embodiments, additional features may be added to hinder inadvertent removal of the handle from the rotatable handle assembly. In some forms, a detent, such as a lip, ridge, or similar structure may be positioned on the external surface of the housing which would have to be overcome in order to remove the handle from the housing.

What is claimed is:

1. A rotatable handle assembly comprising:

a clip member for attachment to an object, the clip member comprising a track; and an actuator attached to the clip member and movable relative to the clip member along the track, the actuator operable to drive a braking member into contact with the track to secure the actuator into a fixed position with respect to the track and the object to which the clip member is attached, wherein the braking member comprises a pair of lever arms, each lever arm including a braking surface positioned adjacent to the track, wherein the actuator further comprises a cam member, wherein at least a portion of the cam member is positioned between the pair of lever arms, the actuator operable to separate the pair of lever arms upon rotation of the cam member, and wherein the actuator is movable between an unlocked position wherein the cam member does not apply a force to the pair of lever arms and a locked position wherein the cam member applies a force to the pair of lever arms.

2. The rotatable handle assembly of claim 1, further comprising a rotatable handle coupled to the actuator, wherein rotating the rotatable handle about a longitudinal axis of the rotatable handle rotates the cam member.

3. The rotatable handle assembly of claim 1, further comprising a rotatable handle coupled to the actuator, wherein the braking member and the cam member are seated in the rotatable handle.

4. The rotatable handle assembly of claim 1, wherein the track is positioned along an external surface of the clip member.

5. The rotatable handle assembly of claim 1, wherein an internal surface of the clip member has a geometry corresponding to an external surface of the object to which the rotatable handle assembly is connected.

6. The rotatable handle assembly of claim 1, wherein the clip member is c-shaped.

7. The rotatable handle assembly of claim 1, wherein, in the locked position, the cam member separates the pair of lever arms when the cam member applies a force to the pair of lever arms.

8. The rotatable handle assembly of claim 1, wherein the actuator further includes a resilient member, the resilient member biasing the pair of lever arms towards each other.

9. A rotatable handle assembly comprising:

a rotatable handle;

a track; and an actuator slidably mounted to the track such that the actuator able to slide along the track, the actuator comprising a braking member and a cam member, the braking member comprising at least one lever arm having a braking surface, the braking surface positioned adjacent to the track and the at least one lever arm positioned adjacent to the cam member, wherein rotating the rotatable handle about a longitudinal axis rotates the cam member and causes the cam member to contact the at least one lever arm and the at least one braking surface to contact the track to inhibit movement of the actuator along the track.

10. The rotatable handle assembly of claim 9, wherein the track is part of a clip member that is configured to be affixed to an object.

11. The rotatable handle assembly of claim 9, wherein the actuator is movable between a locked position wherein the braking surface is in contact with the track and an unlocked position wherein the braking surface is out of contact with the track.

12. The rotatable handle assembly of claim 9, wherein at least a portion of the actuator is contained in a housing, the housing comprising two complementary portions.

13. The rotatable handle assembly of claim 12, wherein the two complementary portions of the housing mate together along the track.

14. The rotatable handle assembly of claim 13, wherein the two complementary portions of the housing are secured in the rotatable handle via a friction fit connection, wherein the two complementary portions of the housing are removable from the rotatable handle via an application of manual pressure.

* * * * *